US007180234B2

(12) United States Patent
Oono

(10) Patent No.: US 7,180,234 B2
(45) Date of Patent: Feb. 20, 2007

(54) FIELD EMISSION DISPLAY DEVICE AND METHOD OF MANUFACTURING SAME

(75) Inventor: Katsumi Oono, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/856,817

(22) Filed: Jun. 1, 2004

(65) Prior Publication Data

US 2004/0239235 A1 Dec. 2, 2004

(30) Foreign Application Priority Data

Jun. 2, 2003 (JP) ..... 2003-156331
Mar. 24, 2004 (JP) ..... 2004-086059

(51) Int. Cl.
*H01J 9/02* (2006.01)
*H01J 21/10* (2006.01)
*H01J 1/62* (2006.01)
*H01J 9/00* (2006.01)

(52) U.S. Cl. ..... 313/497; 313/495; 313/309; 313/310; 445/24

(58) Field of Classification Search ..... 313/497, 313/309–310
See application file for complete search history.

(56) References Cited

U.S. PATENT DOCUMENTS

| | | | | | |
|---|---|---|---|---|---|
| 3,500,102 | A | | 3/1970 | Crost et al. | 313/483 |
| 4,857,799 | A | | 8/1989 | Spindt et al. | 313/497 |
| 5,559,389 | A | * | 9/1996 | Spindt et al. | 313/310 |
| 5,633,560 | A | * | 5/1997 | Huang | 313/495 |
| 5,973,444 | A | * | 10/1999 | Xu et al. | 313/309 |
| 5,998,916 | A | * | 12/1999 | Kim | 313/309 |
| 6,045,426 | A | * | 4/2000 | Wang et al. | 445/24 |
| 6,563,260 | B1 | * | 5/2003 | Yamamoto et al. | 313/495 |
| 2002/0094494 | A1 | * | 7/2002 | Chung et al. | 430/311 |

FOREIGN PATENT DOCUMENTS

| | | | |
|---|---|---|---|
| JP | 2002-324501 | A | 11/2002 |
| JP | 2002324501 | A * | 11/2002 |

* cited by examiner

*Primary Examiner*—Nimeshkumar D. Patel
*Assistant Examiner*—Natalie K. Walford
(74) *Attorney, Agent, or Firm*—Birch, Stewart, Kolasch & Birch, LLP

(57) ABSTRACT

In a field emission display device, an opening dimension in a predetermined direction (or x direction) of an opening of a control electrode is greater than an opening dimension in the predetermined direction of an electron pass aperture of a shield electrode, and the shield electrode is located at the front of the control electrode so that the entire range of the opening dimension in the predetermined direction of the electron pass aperture is within the range of the opening dimension in the predetermined direction of the opening of the control electrode.

5 Claims, 5 Drawing Sheets

FIELD EMISSION DISPLAY DEVICE AND METHOD OF MANUFACTURING SAME

BACKGROUND OF THE INVENTION

1. Field of the Invention

The present invention relates to a field emission display device capable of improving light emission uniformity of a phosphor surface (or display surface) of the field emission display device, and a method of manufacturing the same.

2. Description of the Background Art

In general, a field emission display device principally includes a cathode substrate formed with cathode electrodes, an insulating layer formed on the cathode substrate and the cathode electrodes, control electrodes formed on the insulating layer, electron emission material layers received in openings formed through the control electrodes and the insulating layer and formed on exposed portions of the cathode electrodes at the bottom of the openings, and an anode substrate located at the front of the control electrodes and formed with anode electrodes and phosphors (U.S. Pat. No. 3,500,102 (See FIGS. 1 to 4) and U.S. Pat. No. 4,857,799 (See FIGS. 2 and 3)). In the conventional field mission display devices of this type, the openings of the control electrodes are circular in shape.

Some of such field emission display devices further include a shield electrode located between the control electrodes and the anode electrodes and formed with electron pass apertures through which an electron beam flowing from the electron emission material layers to the phosphors passes (Japanese Patent Application Laid-Open No. 2002-324501). In the conventional field emission display devices of this type, the openings of the control electrodes are circular in shape, as described above. Each of the electron pass apertures of the shield electrode is, for example, circular in shape and sized so that all of the opening areas of the corresponding openings of the control electrodes are within the opening area of each electron pass aperture (neither too large nor too small in size) (See FIG. 4 of Japanese Patent Application Laid-Open No. 2002-324501). In this structure, the intensity of the electron beam flowing from each of the electron emission material layers through the corresponding openings of the control electrodes and the corresponding electron pass aperture of the shield electrode to the corresponding phosphor is proportional to the area in which the opening areas of the corresponding openings of the control electrode overlap the opening area of the electron pass aperture of the shield electrode.

In the conventional field emission display devices, the openings through the control electrodes and the insulating layer are formed by a photograph manufacturing process. Specifically, a photosensitive control electrode material layer is formed on the insulating layer, and only portions of the photosensitive control electrode material layer which are to be formed as the control electrodes are exposed to light to change to the control electrodes, while portions to be formed as the openings are unexposed. A developer is caused to flow over the photosensitive control electrode material layer to erode and remove the unexposed portions (to be formed as the openings) of the photosensitive control electrode material layer and portions of the insulating layer corresponding to the unexposed portions, thereby forming the openings through the control electrodes and the insulating layer.

In the field emission display device including the shield electrode, each electron pass aperture of the shield electrode is sized so that all of the opening areas of the corresponding openings of the control electrodes are within the opening area of each electron pass aperture. Therefore, the shield electrode is required to be assembled between the control electrodes and the anode electrodes with high assembly accuracy so that all of the opening areas of the corresponding openings of the control electrodes are within the opening area of each electron pass aperture of the shield electrode without extending off.

Further, if a shift of the assembly position of the shield electrode causes a difference between phosphors in the area in which the opening area of the corresponding electron pass aperture of the shield electrode overlaps the opening areas of the corresponding openings of the control electrodes, variations in the intensity of the electron beam flowing to the phosphors give rise to nonuniform amounts of light emission from the phosphors, resulting in a problem such that the light emission uniformity of a phosphor surface (display surface) of the field emission display device is impaired. Moreover, such defective products lead to increased manufacturing costs.

Furthermore, because the openings formed through the control electrodes and the insulating layer are circular in shape, the reduction in the diameter of the openings makes it difficult for the developer flow to spread to the bottoms of the openings during the formation of the openings. This requires much time for the formation of the openings and makes it difficult to form the openings. For this reason, the diameter of the openings must be large, which results in a problem such that the openings cannot be formed densely, and the intensity of the electron beam decreases.

SUMMARY OF THE INVENTION

It is a first object of the present invention to provide a field emission display device capable of achieving the assembly of a shield electrode without the need for high assembly accuracy so that the light emission uniformity of a phosphor surface (or a display surface) of the field emission display device is maintained.

It is a second object of the present invention to provide a method of manufacturing a field emission display device capable of densely forming openings in a control electrode and an insulating layer, thereby to increase the intensity of an electron beam.

According to the present invention, a field emission display device includes a cathode substrate, an electron emission material layer, a control electrode, an anode substrate, and a shield electrode. The cathode substrate has a cathode electrode formed thereon. The electron emission material layer is formed on the cathode electrode. The control electrode is located at the front of the electron emission material layer and is formed with at least one opening opposed to the electron emission material layer. The anode substrate has an anode electrode and a phosphor formed thereon, and is located at the front of the control electrode. The shield electrode is located between the control electrode and the anode electrode and is formed with an electron pass aperture through which an electron beam flowing from the electron emission material layer via the opening of the control electrode to the phosphor passes. An opening dimension in a predetermined direction of the opening of the control electrode is greater than an opening dimension in the predetermined direction of the electron pass aperture of the shield electrode. The shield electrode is located at the front of the control electrode so that the entire range of the opening dimension in the predetermined direction of the electron pass aperture of the shield electrode is within the range of the opening dimension in the predetermined direction of the opening of the control electrode.

Therefore, if the assembly position of the shield electrode is shifted in the predetermined direction, the field emission display device can eliminate variations in the area in which the opening area of each electron pass aperture of the shield electrode overlaps the opening area of the corresponding opening of the control electrode. Thus the field emission display device can eliminate variations in the intensity of the electron beam flowing to each of the phosphors. This achieves the assembly of the shield electrode without the need for high assembly accuracy so that light emission uniformity of a phosphor surface (or display surface) of the field emission display device is maintained.

The present invention is also intended for a method of manufacturing a field emission display device. According to the present invention, the method includes the following steps (a) to (d). The step (a) is to form a cathode electrode on a cathode substrate. The step (b) is to form an insulating layer on the cathode substrate and the cathode electrode, and to form a photosensitive control electrode material layer on the insulating layer. The step (c) is to expose to light a portion of the photosensitive control electrode material layer to be formed as a control electrode to change the portion into the control electrode, while a portion of the photosensitive control electrode material layer to be formed as an opening is left unexposed. The step (d) is to erode and remove the unexposed portion of the photosensitive control electrode material layer and a portion of the insulating layer lying under the unexposed portion by using a chemical solution, thereby to form the control electrode on the insulating layer and to form the opening through the control electrode and the insulating layer. In the step (c), the unexposed portion of the photosensitive control electrode material layer is formed into a substantially rectangular shape. In the step (d), the chemical solution is caused to flow on the surface of the photosensitive control electrode material layer in a longitudinal direction of the unexposed portion of the photosensitive control electrode material layer to erode and remove the unexposed portion of the photosensitive control electrode material layer and the portion of the insulating layer lying under the unexposed portion.

The method produces the effects of: (1) allowing the flow of chemical solution to effectively spread to the bottom of the opening formed through the control electrode and the insulating layer; and (2) forming the opening in a relatively short period of time. The above-mentioned effect (1) allows the flow of chemical solution to spread sufficiently to the bottom of the opening if an opening dimension in a direction orthogonal to the longitudinal direction of the substantially rectangular opening of the control electrode is decreased to some extent. This achieves the formation of the opening of an elongated shape. The above-mentioned effect (2) prevents the chemical solution from eroding the periphery of the opening more than expected and, accordingly, providing the greater opening area of the opening than expected. This reduces the spacing between the opening and its adjacent opening. These effects provide the elongated openings closely spaced apart from each other (or densely formed), to increase the intensity of the electron beam flowing to each phosphor.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
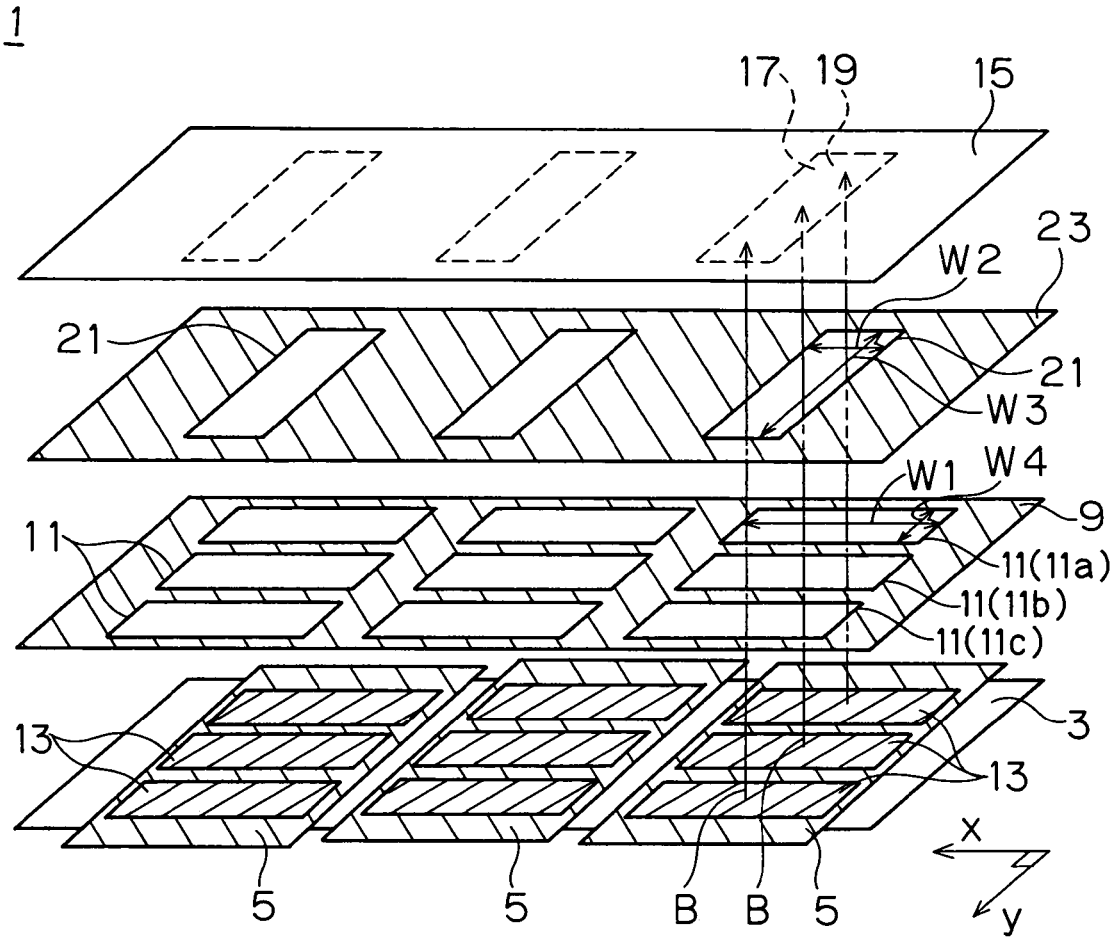
FIG. 1 is a schematic perspective view of a field emission display device according to a preferred embodiment of the present invention.
Figure 2:
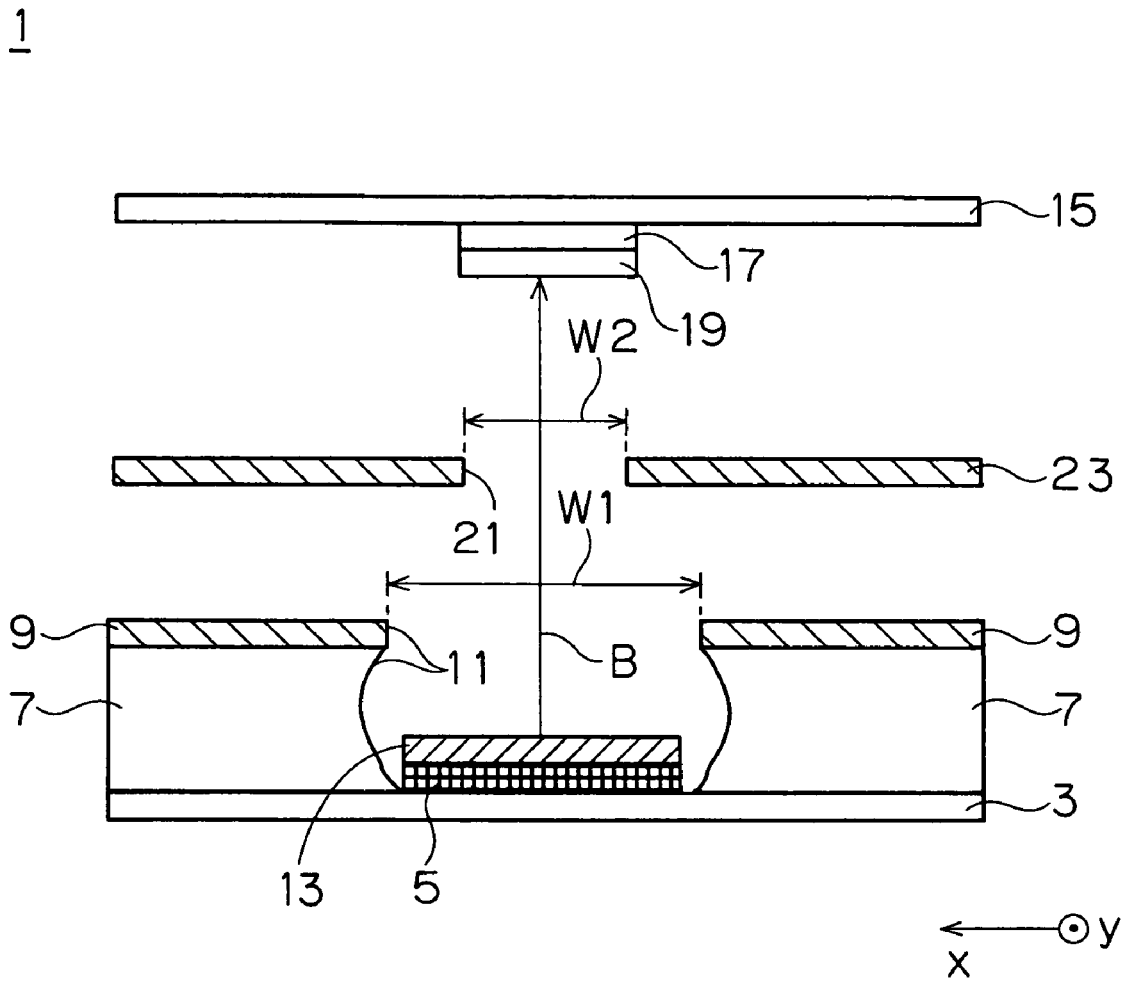
FIG. 2 is a schematic side view showing the construction of the field emission display device according to the preferred embodiment of the present invention.

As shown in FIGS. 1 and 2, a field emission display device 1 according to this preferred embodiment of the present invention includes a cathode substrate 3, cathode electrodes 5 formed on the cathode substrate 3, flat electron emission material layers 13 formed on the cathode electrodes 5 and substantially similar in shape to, for example, openings 11 of a control electrode 9 to be described later, the control electrode 9 located at the front of the electron emission material layers 13 and having the openings 11 opposed to the electron emission material layers 13, a transparent anode substrate 15 located at the front of the control electrode 9, for example, transparent anode electrodes 17 formed on the rear surface of the anode substrate 15, phosphors 19 formed on the anode electrodes 17, and a shield electrode 23 located between the control electrode 9 and the anode electrodes 17 and formed with electron pass apertures 21 through which an electron beam B flowing from the electron emission material layers 13 via the openings 11 of the control electrode 9 to the phosphors 19 passes.

In this preferred embodiment, an insulating layer 7 is formed on the cathode substrate 3 and above the cathode electrodes 5, and the control electrode 9 is formed on the insulating layer 7. The openings 11 are formed through the control electrode 9 and the insulating layer 7. The electron emission material layers 13 are formed on the cathode electrodes 5 exposed at the bottom of the openings 11 in such a manner as to be accommodated in the openings 11.

The shield electrode 23 functions herein to protect the electron emission material layers 13 against a high voltage applied to the anode electrodes 17. The control electrode 9 functions as an extraction electrode (or gate electrode) for emission (or extraction) of electrons from the electron emission material layers 13.

The plurality of cathode electrodes 5 (only three of which are shown in FIG. 1) are, for example, in the form of strips each extending in the y direction and having a predetermined width, and are in parallel spaced apart relation to each other.

A plurality of control electrodes 9 (only one of which is shown in FIG. 1) are, for example, in the form of strips each extending in the x direction and having a predetermined width, and are formed on the insulating layer 7 so as to be orthogonal to the cathode electrodes 5 and in parallel spaced apart relation to each other.

The above-mentioned openings 11 of a substantially rectangular (herein rectangular) configuration are formed at intersections of the cathode electrodes 5 and the control electrodes 9. The openings 11 (herein three openings 11*a*, 11*b* and 11*c*) extend in orthogonal relation to the longitudinal direction (the y direction) of the phosphors 19 and are in parallel spaced apart relation to each other (although only one opening 11 may be required). The openings 11*a*, 11*b*, 11*c* are formed so that an opening dimension W1 in a predetermined direction (herein a direction (the x direction) orthogonal to the longitudinal direction of the phosphors 19) thereof is greater than an opening dimension W2 in the above-mentioned predetermined direction (the x direction) of the corresponding electron pass aperture 21 of the shield electrode 23. The electron emission material layers 13 are geometrically similar in shape to the corresponding openings 11*a*, 11*b* and 11*c* of the control electrode 9.

The phosphors 19 are formed, for example, one for each of the portions of the anode electrodes 17 opposed to the respective intersections of the cathode electrodes 5 and the control electrodes 9. The phosphors 19 are, for example, of the same size and of a linear shape (i.e., elongated rectangular shape), and extend in the same direction (herein the y direction).

The shield electrode 23 is, for example, in the form of a plate approximately coextensive with the cathode substrate 3. The above-mentioned electron pass apertures 21 are formed in portions of the shield electrode 23 opposed to the respective phosphors 19 on the anode electrodes 17. The electron pass apertures 21 are of a substantially rectangular shape and of substantially the same size as the phosphors 19. Each of the electron pass apertures 21 is provided so that the longitudinal direction thereof extends along the longitudinal direction (or in the y direction) of a corresponding one of the phosphors 19.

Figure 3:
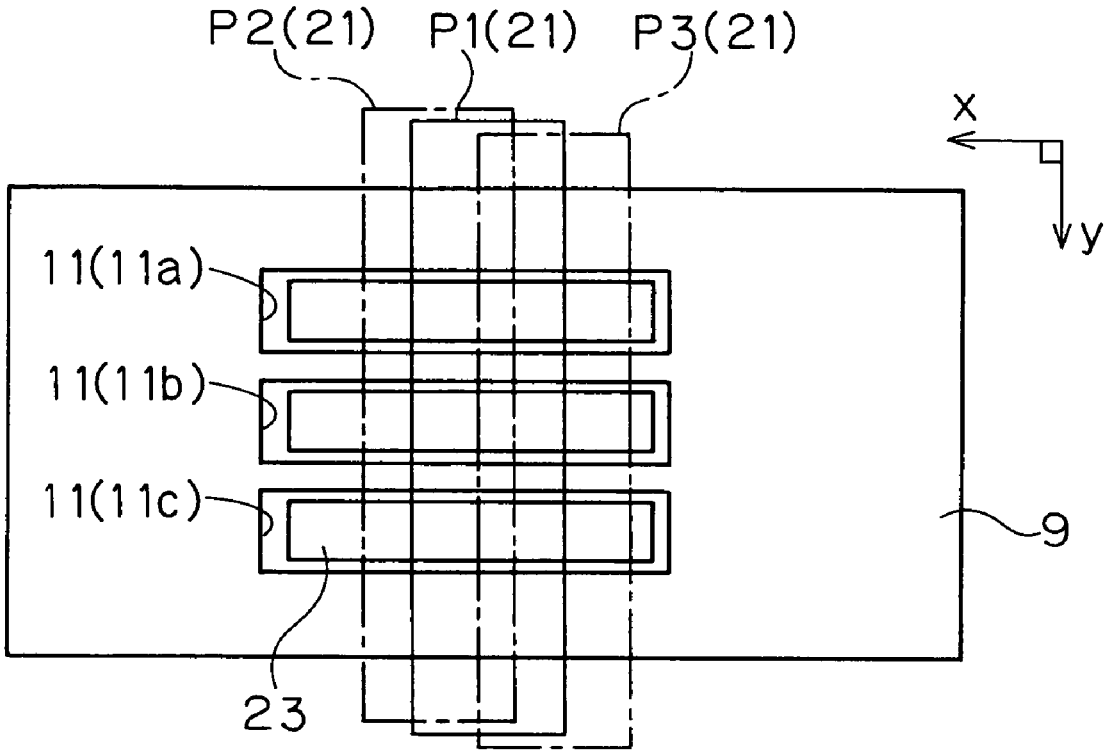
FIG. 3 is a schematic plan view of openings of a control electrode as seen from an electron pass aperture of a shield electrode in the field emission display device according to the preferred embodiment of the present invention.

The shield electrode 23 is located between the control electrode 9 and the anode electrodes 17 so that each of the electron pass apertures 21 thereof is positioned in front of the corresponding phosphor 19 on the anode substrate 15 and so that each of the electron pass apertures 21 is orthogonal to the corresponding openings 11 of the control electrode 9 (i.e., with reference to FIG. 3, so that the entire range of the opening dimension W2 in the x direction of each electron pass aperture 21 is within the range of the opening dimension W1 in the x direction of the corresponding openings 11 of the control electrode 9 and so that the entire range of an opening dimension W4 in the y direction of all of the corresponding openings 11*a*, 11*b* and 11*c* of the control electrode 9 is within the range of an opening dimension W3 in the y direction of each electron pass aperture 21).

Although not shown, the field emission display device 1 further includes spacing holding elements for holding the spacing between the substrates 3, 15 and the shield electrode 23, an envelope for hermetically sealing a space between the substrates 3 and 15 to maintain a vacuum therein, and drive circuits for applying voltages to the respective electrodes 5, 9, 17, and 23.

In the field emission display device 1, a high voltage (e.g., 14 kV) for electron acceleration is normally applied to the anode electrodes 17. A voltage lower than the voltage applied to the anode electrodes 17 (e.g., a voltage as high as a voltage applied to the control electrode 9) is normally applied to the shield electrode 23 for the purpose of shielding against a high-voltage electric field from the anode electrodes 17. A scanning voltage is scanned and applied to one of the cathode electrode 5 and the control electrode 9, and a display voltage is selectively applied to the other. A voltage (e.g., 500 V) required for electron emission due to a difference between the scanning voltage and the display voltage is applied to the electron emission material layers 13 at the intersections of the cathode electrodes 5 and the control electrodes 9 applied with the scanning voltage and the display voltage, whereby electrons (or the electron beam B) are emitted from the electron emission material layers 13. The emitted electron beam B passes through the corresponding openings 11 of the control electrodes 9 and the corresponding electron pass aperture 21 of the shield electrode 23, and are accelerated by the high voltage of the anode electrodes 17 to impinge upon the corresponding phosphor 19, thereby causing the phosphor 19 to emit light.

Next, a method of manufacturing the field emission display device 1 will now be described.

Figure 4A:
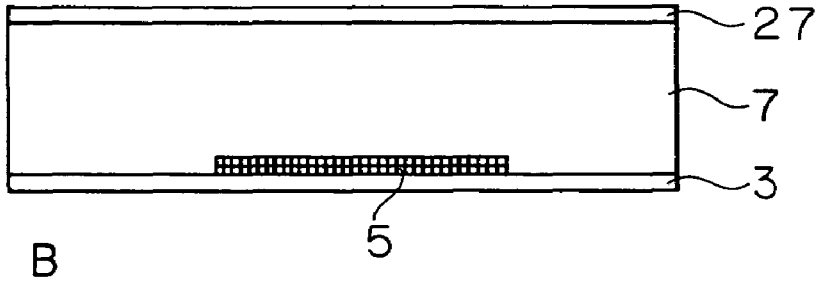
FIGS. 4A to 4C are views for illustrating a method of manufacturing the field emission display device according to the preferred embodiment of the present invention.

First, as shown in FIG. 4A, the cathode electrode 5 is formed on the cathode substrate 3, and the insulating layer 7 is formed on the cathode substrate 3 and the cathode electrode 5. A photosensitive control electrode material layer 27 is formed on the insulating layer 7.

Figure 4B:
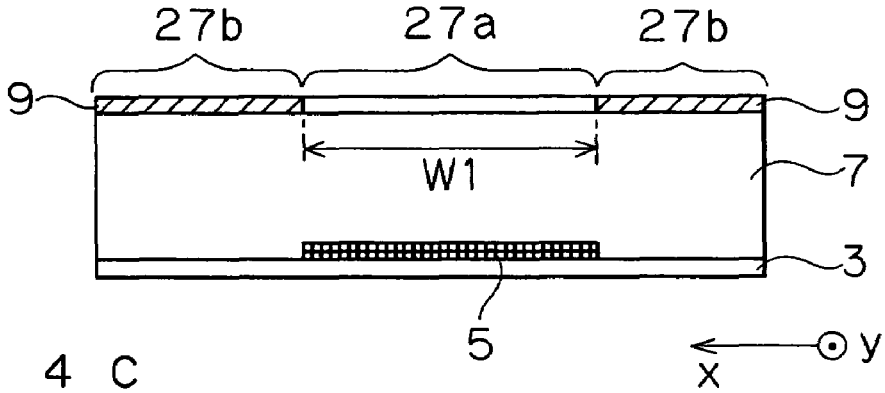

Then, as shown in FIG. 4B, ultraviolet light is selectively directed through a photomask onto the formed photosensitive control electrode material layer 27, to expose only a portion 27*b* of the photosensitive control electrode material layer 27 which is to be formed as the control electrode 9 to light, thereby curing the portion 27*b* into the control electrode 9, while a portion 27*a* of the photosensitive control electrode material layer 27 which is to be formed as the opening 11 is unexposed. The unexposed portion 27*a* (which is to be formed as the opening 11) is formed in a substantially rectangular shape.

Figure 4C:
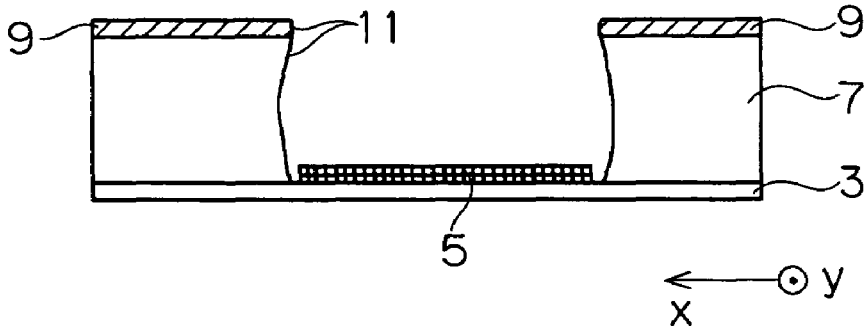

Then, as shown in FIG. 4C, a chemical solution (herein, a developing solution) is sprayed onto the photosensitive control electrode material layer 27 (27*a* and 27*b*) so as to flow on an upper surface of the photosensitive control electrode material layer 27 in the longitudinal direction (the x direction) of the unexposed portion 27*a* of the photosensitive control electrode material layer 27, thereby to erode and remove the unexposed portion 27*a* of the photosensitive control electrode material layer 27 and a portion of the insulating layer 7 which lies under the unexposed portion 27*a*. This provides the substantially rectangular opening 11 formed through the control electrode 9 and the insulating layer 7 and having a bottom at which the cathode electrode 5 is exposed. Since the chemical solution is caused to flow on the surface of the photosensitive control electrode material layer 27 in the longitudinal direction of the unexposed portion 27*a* of the photosensitive control electrode material layer 27, the flow of the chemical solution can effectively spread to the bottom of the opening 11 formed through the control electrode 9 and the insulating layer 7.

Then, as shown in FIG. 2, the electron emission material layer 13 is formed on the cathode electrode 5 exposed at the bottom of the opening 11 in such a manner as to be accommodated in the opening 11 formed through the control electrode 9 and the insulating layer 7.

Next, as shown in FIGS. 2 and 3, the shield electrode 23 formed with the substantially rectangular electron pass apertures 21 is assembled, for example, to the cathode substrate 3 so as to be located at the front of the control electrode 9 and so that each electron pass aperture 21 thereof is orthogonal to the corresponding openings 11 of the control electrode 9.

The substantially rectangular electron pass apertures 21 of the shield electrode 23 are located in orthogonal relation to the substantially rectangular openings 11 of the control electrode 9. Therefore, if the assembly position P1 of the shield electrode 23 is shifted along the plane of the control electrode 9 (e.g., to positions P2 and P3 (See FIG. 3) shifted in the longitudinal direction (the x direction) of the openings 11 of the control electrode 9), variations are eliminated between the phosphors 19 in the area in which the opening area of a corresponding electron pass aperture 21 of the shield electrode 23 overlaps the opening area of a corresponding opening 11 of the control electrode 9. Therefore, variations are eliminated in the intensity of the electron beam B flowing to each of the phosphors 19.

Figure 5:
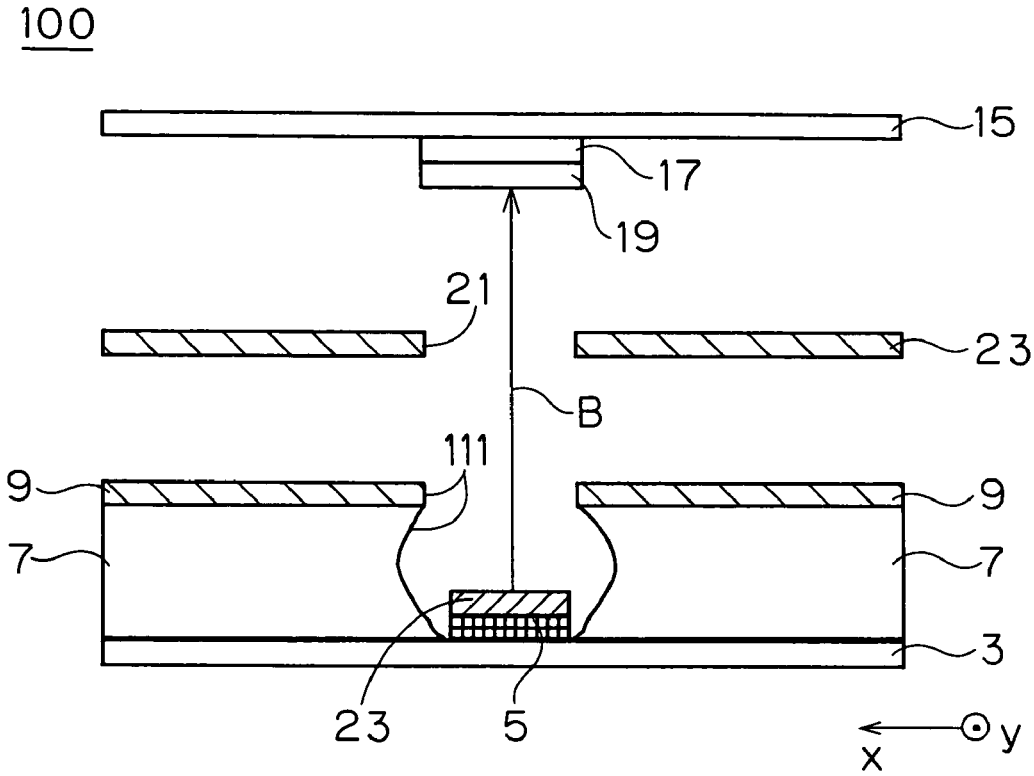
FIG. 5 is a schematic side view showing the construction of a conventional field emission display device.
Figure 6:
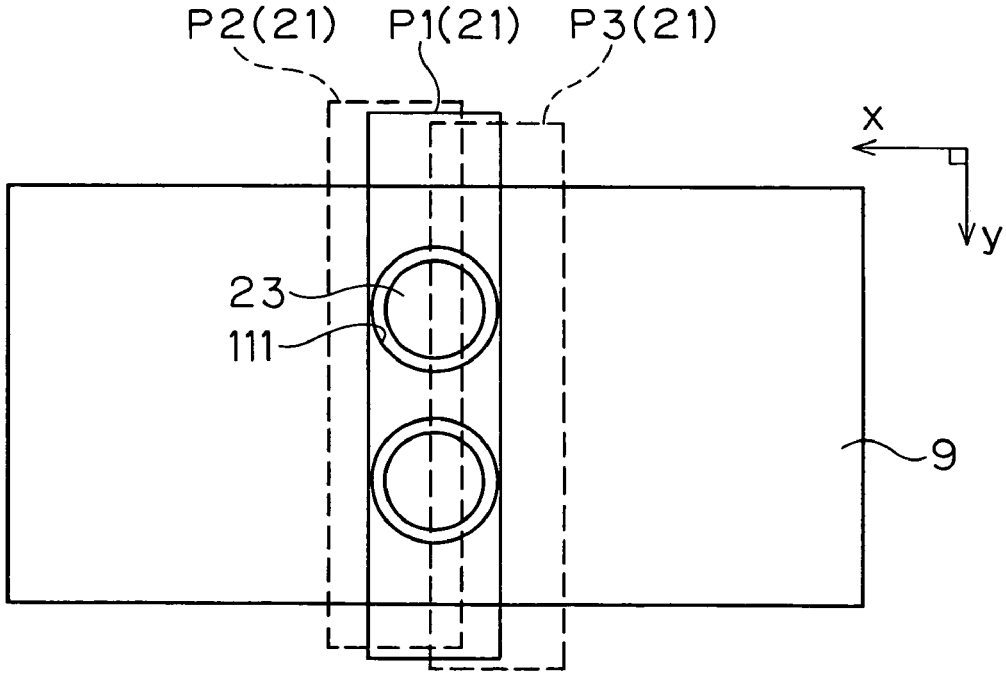
FIG. 6 is a schematic plan view of openings of the control electrode as seen from an electron pass aperture of the shield electrode in the conventional field emission display device.

If openings 111 of the control electrode 9 are, for example, circular in shape and sized to be within the electron pass aperture 21 of the shield electrode 23 as in a conventional field emission display device 100 shown in FIGS. 5 and 6, the shift of the assembly position of the shield electrode 23 along the plane of the control electrode 9 (e.g., to the positions P2 and P3 shifted in the x direction) causes the variations between the phosphors 19 in the area in which the opening area of the corresponding electron pass aperture 21 of the shield electrode 23 overlaps the opening area of the corresponding opening 111 of the control electrode 9, thereby causing the variations in the intensity of the electron beam B flowing to each of the phosphors 19.

Next, as shown in FIG. 2, the anode substrate 15 formed with the anode electrodes 17 and the phosphors 19 is assembled, for example, to the cathode substrate 3 so as to be located at the front of the shield electrode 23 and so that the phosphors 19 are located at the front of the corresponding electron pass apertures 21 of the shield electrode 23.

In the field emission display device 1 constructed as described above, the opening dimension W1 in the predetermined direction (the x direction) of each of the openings 11 of the control electrode 9 is greater than the opening dimension W2 in the above-mentioned predetermined direction of the corresponding electron pass aperture 21 of the shield electrode 23, and the shield electrode 23 is located at the front of the control electrode 9 so that the entire range of the opening dimension W2 in the predetermined direction of each of the electron pass apertures 21 is within the range of the opening dimension W1 in the predetermined direction of the corresponding opening 11 of the control electrode 9. Therefore, if the assembly position of the shield electrode 23 is shifted in the above-mentioned predetermined direction, the field emission display device 1 eliminates the variations between the phosphors 19 in the area in which the opening area of the corresponding electron pass aperture 21 of the shield electrode 23 overlaps the opening area of the corresponding opening 11 of the control electrode 9, thereby to eliminate the variations in the intensity of the electron beam B flowing to each of the phosphors 19. This achieves the assembly of the shield electrode 23 so as to maintain the light emission uniformity of the phosphor surface (display surface) of the field emission display device 1 without the need for high assembly accuracy.

The electron pass apertures 21 of the shield electrode 23 are in the substantially rectangular shape (herein, rectangular shape), and the openings 11 of the control electrode 9 are in the substantially rectangular shape which intersects (herein, in orthogonal relation to) the electron pass apertures 21 of the shield electrode 23. Therefore, if the assembly position of the shield electrode 23 is shifted along the plane of the control electrode 9, the field emission display device 1 eliminates the variations between the phosphors 19 in the area in which the opening area of the corresponding electron pass aperture 21 of the shield electrode 23 overlaps the opening area of the corresponding opening 11 of the control electrode 9.

The plurality of openings 11*a*, 11*b* and 11*c* of the control electrode 9 are formed for each of the electron pass apertures 21 of the shield electrode 23. This increases the intensity of the electron beam B flowing to each of the phosphors 19.

The method of manufacturing the field emission display device 1 carried out as described above includes: forming the unexposed portions 27*a* of the photosensitive control electrode material layer 27 into a substantially rectangular shape; and causing a chemical solution to flow on the surface of the photosensitive control electrode material layer 27 in the longitudinal direction of the unexposed portion 27*a* of the photosensitive control electrode material layer 27, thereby to erode and remove the unexposed portion 27*a* of the photosensitive control electrode material layer 27 and the portion of the insulating layer 7 lying under the unexposed portion 27*a*. This produces the effects of (1) allowing the flow of chemical solution to effectively spread to the bottom of each of the openings 11 formed through the control electrode 9 and the insulating layer 7, and (2) forming the openings 11 in a relatively short period of time. The above-mentioned effect (1) allows the flow of chemical solution to spread sufficiently to the bottom of each of the openings 11 if the opening dimension W4 in the direction orthogonal to the longitudinal direction of the substantially rectangular openings 11 of the control electrode 9 is decreased to some extent. This achieves the formation of the openings 11 of an elongated shape. The above-mentioned effect (2) prevents the chemical solution from eroding the periphery of the openings 11 more than expected and, accordingly, providing the greater opening area of the openings 11 than expected. This reduces the spacing between the openings 11 adjacent to each other. These effects provide the elongated openings 11 closely spaced apart from each other (or densely formed), to increase the intensity of the electron beam B flowing to each of the phosphors 19.

Although the three openings 11*a*, 11*b*, and 11*c* are formed for each of the electron pass apertures 21 in this preferred embodiment, the present invention produces similar effects by forming any number of openings 11 for each electron pass aperture 21.

The opening areas of the respective openings 11*a*, 11*b* and 11*c* corresponding to the same electron pass aperture 21 are of the same size in this preferred embodiment, but may differ from each other if the opening dimension W1 in the predetermined direction of each of the openings 11*a*, 11*b* and 11*c* is greater than the opening dimension W2 in the predetermined direction of the corresponding electron pass aperture 21.

The openings 11 of the control electrode 9 are of the rectangular shape in this preferred embodiment, but may be of a substantially oval shape like a race track, of a rectangular shape with arcuate corners, or of a substantially rectangular shape with tapered opposed sides.

The method of manufacturing the field emission display device 1 according to this preferred embodiment uses ultraviolet light for exposure, but light for use in the exposure is not limited to the ultraviolet light.

The method of manufacturing the field emission display device 1 according to this preferred embodiment described above uses the control electrode 9 as the extraction electrode (or a grid electrode). However, the method is applicable to the control electrode 9 used as an electrode having other functions (e.g., a focusing electrode) than the extraction electrode if the openings 11 are formed in the control electrode 9 by the erosion of a chemical solution.

While the invention has been described in detail, the foregoing description is in all aspects illustrative and not restrictive. It is understood that numerous other modifications and variations can be devised without departing from the scope of the invention.

What is claimed is:

1. A field emission display device comprising:

a cathode substrate with a cathode electrode formed thereon;

an electron emission material layer formed on said cathode electrode;

a control electrode located at the front of said electron emission material layer and formed with at least one opening opposed to said electron emission material layer;

an anode substrate with an anode electrode and a phosphor formed thereon, said anode substrate being located at the front of said control electrode; and a shield electrode located between said control electrode and said anode electrode and formed with an electron pass aperture through which an electron beam flowing from said electron emission material layer via said opening of said control electrode to said phosphor passes, wherein an opening dimension in a predetermined direction of said opening of said control electrode is greater than an opening dimension in said predetermined direction of said electron pass aperture of said shield electrode, and said shield electrode is located at the front of said control electrode so that the entire range of said opening dimension in said predetermined direction of said electron pass aperture of said shield electrode is within the range of said opening dimension in said predetermined direction of said opening of said control electrode, and wherein said electron pass aperture of said shield electrode has a substantially rectangular shape, and said opening of said control electrode has a substantially rectangular shape intersecting said electron pass aperture of said shield electrode.

2. The field emission display device according to claim 1, wherein said at least one opening of said control electrode includes a plurality of openings, and said plurality of openings of said control electrode are formed for said electron pass aperture of said shield electrode.

3. The field emission display device according to claim 1, wherein said electron emission material layer has substantially the same shape as said opening of said control electrode.

4. The field emission display device according to claim 2, wherein said electron emission material layer has substantially the same shape as said opening of said control electrode.

5. A method of manufacturing a field emission display device, comprising the steps of:

(a) forming a cathode electrode on a cathode substrate;

(b) forming an insulating layer on said cathode substrate and said cathode electrode, and forming a photosensitive control electrode material layer on said insulating layer;

(c) exposing to light a portion of said photosensitive control electrode material layer to be formed as a control electrode to change said portion into said control electrode, while a substantially rectangular shaped portion of said photosensitive control electrode material layer to be formed as an opening is left unexposed; and (d) eroding and removing said unexposed portion of said photosensitive control electrode material layer and a portion of said insulating layer lying under said unexposed portion by causing a chemical solution to flow on the surface of said photosensitive control electrode material layer in a longitudinal direction of said unexposed portion of said photosensitive control electrode material, thereby to form said control electrode on said insulating layer and to form said opening through said control electrode and said insulating layer.

* * * * *